US006123808A

United States Patent [19]

Bechard et al.

[11] Patent Number: 6,123,808

[45] Date of Patent: Sep. 26, 2000

[54] DISTRIBUTION OF DILUTION LIQUOR TO THE DISCHARGE OF A CELLULOSE PULP DIGESTER

[75] Inventors: Grant E. Bechard; John Hefele; Larry W. Laakso; Mark D. Barrett, all of Queensbury, N.Y.; R. Fred Chasse, Stratham, N.H.

[73] Assignee: Ahlstrom Machinery Inc., Glens Falls, N.Y.

[21] Appl. No.: 08/987,772

[22] Filed: Dec. 9, 1997

[51] Int. Cl.[7] ..... D21C 7/14

[52] U.S. Cl. ..... 162/18; 162/41; 162/57

[58] Field of Search ..... 162/17, 18, 19, 162/41, 57

[56] References Cited

U.S. PATENT DOCUMENTS

| | | | |
|---|---|---|---|
| 3,035,963 | 5/1962 | Schnyder | 162/19 |
| 3,298,899 | 1/1967 | Laakso | 162/19 |
| 3,429,773 | 2/1969 | Richter | 162/247 |
| 3,532,594 | 10/1970 | Richter | 162/19 |
| 3,711,367 | 1/1973 | Christenson | 162/251 |
| 3,802,956 | 4/1974 | Backlund | 162/19 |
| 3,811,994 | 5/1974 | Ostberg | 162/19 |
| 4,174,997 | 11/1979 | Richter | 162/19 |
| 4,547,264 | 10/1985 | Sherman et al. | 162/37 |
| 5,069,752 | 12/1991 | Richter | 162/37 |
| 5,236,554 | 8/1993 | Greenwood | 162/238 |
| 5,470,437 | 11/1995 | Oulie et al. | 162/237 |

*Primary Examiner*—Dean T. Nguyen
*Attorney, Agent, or Firm*—Nixon & Vanderhye P.C.

[57] ABSTRACT

In a pulp treatment vessel, such as a kraft pulp continuous vertical digester, a cellulose slurry is caused to flow in the vessel interior in a flow path. A substantially annular void is formed at at least one point along the flow path, and dilution or treatment liquor is introduced into the substantially annular void so that the liquor is substantially uniformly distributed about the periphery of or into the slurry. The annular void may be formed by a step out in the vessel, and the uniform introduction of dilution liquor may be accomplished utilizing one or more openings, such as a plurality of openings substantially evenly spaced around the substantially annular void, e.g. using a screen surface. The screen surface may be substantially vertical or conical.

21 Claims, 4 Drawing Sheets

DISTRIBUTION OF DILUTION LIQUOR TO THE DISCHARGE OF A CELLULOSE PULP DIGESTER

BACKGROUND AND SUMMARY OF THE INVENTION

In the art of chemical pulping of comminuted cellulosic fibrous material, for example, wood chips, the cellulose material is typically treated with cooking chemicals under pressure and temperature in one or more cylindrical vessels, known as digesters. This treatment can be performed continuously or in a batch mode. In the continuous mode, chips are continuously fed into one end of a continuous digester, treated, and essentially continuously discharged from the other end. In the batch method, one or more batch digesters are filled with chips and cooking chemical, capped and then treatment commences. Once the treatment is finished the contents of the batch digester are discharged. In either batch or continuous (e.g. Kamyr®) digesters, discharge of the slurry of essentially fully-cooked comminuted cellulosic fibrous material, that is, wood pulp, is aided by introducing diluting liquor to the vicinity of the discharge. This dilution liquor not only aids in the discharge of the pulp but also cools the pulp and acts to control the liquid content, that is, the consistency, of the discharged slurry.

This process of diluting the pulp prior to discharge has been practiced since the introduction of the continuous digester in the late 1930s and early 1940s. For example, U.S. Pat. No. 2,474,862, having a priority date of Oct. 15, 1942, clearly illustrates the addition of cooling liquid to the outlet of one of Johan Richter's earliest continuous digesters. Similar dilution flows to the outlet of the earlier continuous digesters are shown in Richter's "The History of Kamyr Continuous Cooking" (1981) and in U.S. Pat. No. 2,938, 824. In the late 1950s, it was recognized that introducing cooling dilution to the outlet of a continuous digester to cool the pulp before discharging the pulp under pressure, that is, "blowing", produced a stronger pulp. This concept became known as "Cold Blowing".

In the early 1960s, the concept of counter-current treatment of cellulose material in a continuous digester was first introduced, for example, as described in U.S. Pat. Nos. 3,097,987 of Sloman and 3,007,839 of Richter. Subsequently, counter-current washing in the bottom of the digester was introduced, as described in U.S. Pat. Nos. 3,200,032 of Richter, et al. and 3,298,899 of Laakso. This washing process was marketed under the trademark HI-HEAT. Similar combinations of counter-current HI-HEAT washing and cooling Cold Blow dilution are described in U.S. Pat. Nos. 3,380,833; 3,413,189; 3,425, 898; 3,429,733; 3,445,328; 3,427,218; 3,532,594; 3,579, 418; and 3,811,994. However, in all of the systems illustrated in these patents the cooling dilution liquor is introduced by a series of nozzles distributed uniformly around the periphery of the digester, generally directed perpendicular to the vessel shell dimension of elongation and typically all communicating with a common ring header. For example, 3,007,839 illustrates dilution nozzles directed inward and then downward toward the discharge agitator, or "outlet device".

Even more recent patents, for example, 5,236,553; 5,470, 437; 5,567,280; and 5,620,562 all disclose digesters in which the dilution liquor above the outlet is introduced using radial nozzles.

However, the recent developments in the area of material handling, in particular material handling in chip bins and continuous digesters, indicates that such localized introduction of dilution to comminuted cellulosic fibrous material in vessels interferes with the uniform movement of the material in those vessels. Recent U.S. Pat. Nos. 5,500,083; 5,617, 975; and 5,628,873 disclose novel methods of handling and treating wood chips so that uniform movement and treatment is ensured. Copending application 08/936,047 filed on Sep. 23, 1997 now U.S. Pat. No. 5,985,096 discloses novel methods to apply these principles to the design of digester vessels. These Patents and applications disclose that movement of a slurry of comminuted cellulosic fibrous material and liquid can be dramatically affected by the uniformity of the introduction of liquids to the digester. Non-uniform dilution, for example, can result in localized variation in slurry consistency and produce localized variation in the flow patterns along the vessel internal shell diameter. In the vertical flow of material, any variation in flow characteristics at one level, for example, the friction between the material and the vessel wall, can affect the character of the flow above it. This is particularly the case where dilution is introduced at the bottom of a digester. Typically, this is the only location where liquids are introduced radially inward from the vessel shell. Other liquor introductions, for example, by means of cooking circulations, are introduced by means of a centrally-located conduits, that is, via a "center pipe", which have little direct influence upon the character of the flow along the internal diameter of the vessel. Thus, the radial, localized, non-uniform introduction of liquor at the bottom of the digester can have a significant effect upon the flow of material in the entire digester.

The present invention provides a method and apparatus for introducing liquids to a digester vessel that overcomes the non-uniformities in treatment and material movement that characterizes the prior art. One embodiment of this invention comprises a method for distribution of liquid to a digester or other vessel having a flow path for comminuted cellulosic fibrous material having at least one radial or step increase from a first diameter to a second larger diameter, comprising or consisting of the steps of (a) causing the material to flow past the step increase so that an annular void is created between the material and the second diameter; and (b) introducing liquid into the annular void so that the liquid is distributed around the circumference of the flow path. In one embodiment of this invention, liquid may be introduced to the void by way of one or more nozzles which communicate directly with the void. A preferred device for introducing the liquid is a screen plate located in the vicinity of the step increase. This screen plate may be a right cylindrical screen having an internal diameter substantially equal to the second diameter. The screen may also be a right conical screen plate having a first diameter substantially equal to the first diameter of the flow path and a second diameter essentially equal to the second diameter of the flow path.

The method of introducing liquids to a digester or other vessel is preferably practiced in the lower part of the digester or other vessel, but may be used anywhere along the height of the digester or other vessel where liquor introduction is desirable, and may be provided at more than one position along the vessel.

Particularly, according to the invention a method of treating or producing chemical pulp (such as kraft pulp) using a vessel (typically a vertical vessel) having an interior surface, is provided. The method comprises the steps of: (a) Causing a cellulose slurry to flow in the vessel interior in a flow path. (b) Forming a substantially annular void at at least one point along the flow path. And, (c) introducing dilution or treatment liquor into the substantially annular void so that the liquor is substantially uniformly distributed about the periphery of or into the slurry.

Step (b) may be practiced by providing a horizontal step-out in a vertical vessel. Step (c) may be practiced by causing treatment or dilution liquid to flow into the substantially annular void at a plurality of openings substantially evenly spaced around the substantially annular void. Step (a) is typically practiced causing the slurry to flow substantially downwardly in the vessel. Steps (b) and (c) may be further practiced by disposing a screen adjacent the substantially annular void, the liquid being introduced through the screen. Steps (b) and (c) may also be practiced by providing the screen surface substantially parallel to the flow path, or by providing a substantially conical screen surface which makes an angle of about 30–60° with respect to the flow path.

Step (c) may be practiced by introducing treatment or dilution liquid into a first annular cavity within the vessel, causing the liquid to flow through a plurality of orifices into a second annular chamber within the vessel interior, and then through a screen surface into the vessel interior. Step (c) may be practiced by passing the liquor through a screen surface adjacent the annular void.

The invention also relates to a chemical pulp producing or treating assembly comprising the following components: A substantially vertically elongated vessel, having an interior. Means for forming a substantially annular void volume at at least one location along the vessel interior. And, means for introducing a treatment or dilution liquid into the void.

The introducing means may comprise one or more nozzles which directly communicate with the void, but preferably include a screen surface adjacent the void inside the vessel interior and the annular void forming means may comprise a step out. The introducing means may further comprise a first header inside the vessel interior having a substantially annular chamber in communication with the screen surface, and the introducing means may comprise a plurality of openings in addition to the screen surface. The introducing means may further comprise a second header immediately adjacent the screen surface, and further comprising a plurality of orifices between the first header and the second header allowing liquid flow therebetween. The screen surface may be either substantially vertical, or substantially conical (e.g. at an angle of 30–60° to the vertical).

According to another aspect of the present invention a chemical pulp producing or treating assembly is provided comprising: A substantially vertically elongated vessel having an interior. An extraction or recirculating screen assembly having a first screen surface diameter. A step out substantially immediately below the extraction or recirculating screen assembly. A liquid introducing screen assembly substantially immediately below the step out, and having a second screen surface diameter greater than the first screen diameter by at least one percent (e.g. 2–5%, and typically about 1–12 inches preferably about 1–3 inches). A substantially annular header communicating with the liquid introducing screen assembly. And, liquid being fed to the liquid introducing screen assembly for substantially uniform introduction into pulp moving downwardly in a slurry in the vessel.

The second screen surface may be substantially vertical, or conical. The invention may further comprise a plurality of conduits introducing liquid into the header, and a plate positioned in front of each conduit to deflect the flow of liquid from the conduit so that the liquid does not flow immediately into contact with the second screen surface. The header may comprise a first header, and the assembly may further comprise a second header immediately adjacent the first header, with a plurality of orifices between the first and second headers.

It is the primary object of the present invention to provide for the uniform introduction of dilution or treatment liquid into chemical pulp in a vessel. This and other objects of the invention will become clear from an inspection of the detailed description of the invention and from the appended claims.

DETAILED DESCRIPTION OF THE DRAWINGS

Figure 1:
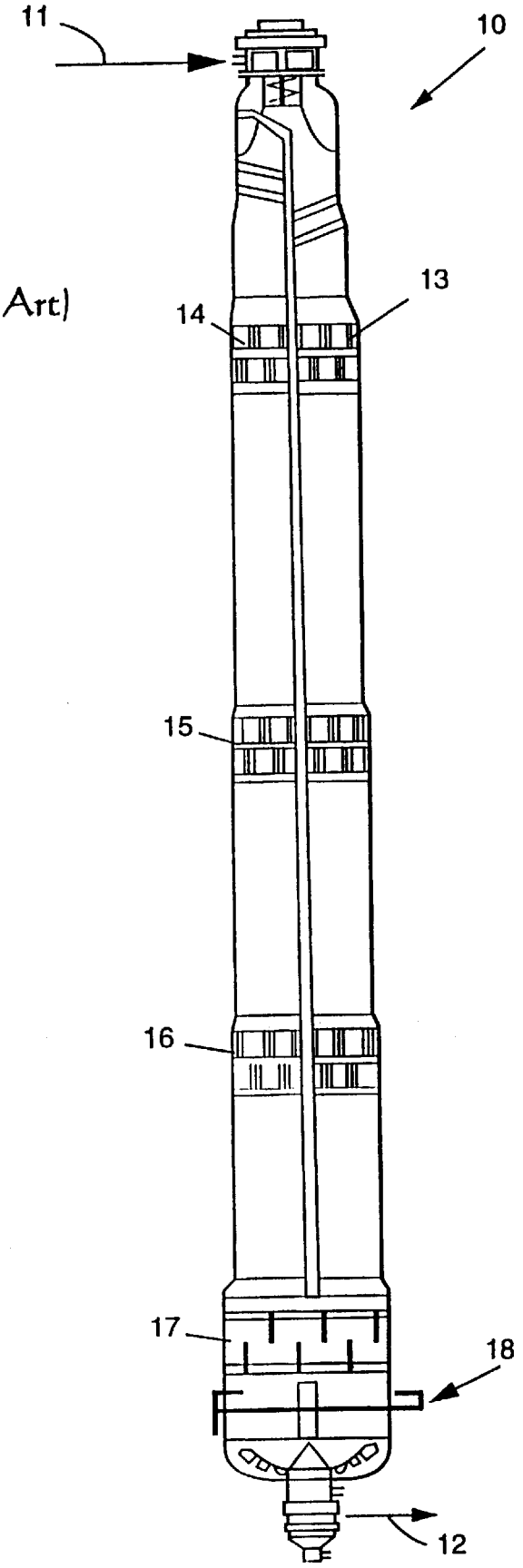
Fig. 1 (Prior Art)
FIG. 1 is a schematic side view of a prior art continuous digester having typical dilution introduction piping in its lower section.

FIG. 1 illustrates a cross-sectional view of a typical prior art continuous digester 10 having typical dilution introduction piping in its lower section. Though a vertical continuous digester is shown, it is to be understood that the present invention is applicable to any type of cylindrical digester, continuous or batch, and to other pulp treating or producing vessels as well.

A slurry of comminuted cellulosic fibrous material and cooking chemical is introduced at the top 11 of the digester 10 and a slurry of fully-cooked pulp and spent cooking liquor is discharged at the bottom 12. The digester 10 comprises a cylindrical shell, 13, and numerous cylindrical screen assemblies 14, 15, 16 and 17. As is typical of the prior art, dilution liquor is introduced using an external wash header and a plurality of radially inwardly directed nozzles 18. A detailed isometric view, partially in cross section, of the bottom section of the digester shown in FIG. 1 is shown in FIG. 2.

Figure 2:
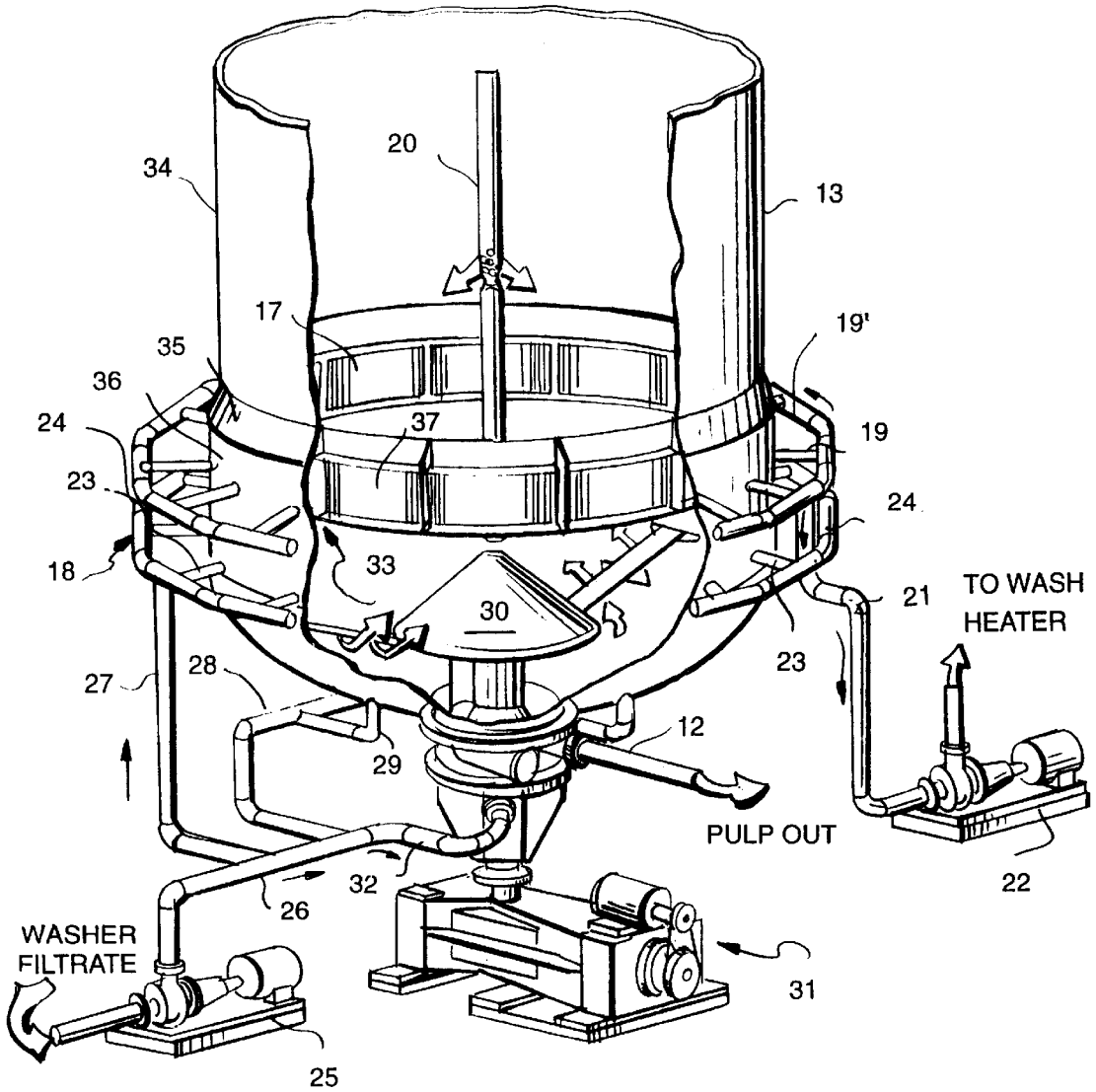
Fig. 2 (Prior Art)
FIG. 2 is a detail isometric view partially in cross-section of the dilution piping of the prior art digester of FIG. 1.

FIG. 2 illustrates a typical prior art apparatus 18 for, among other things, introducing dilution liquid to the bottom of digester 10 prior to discharge of pulp at 12. As is typical in the art, the bottom of the digester 10 includes at least one screen assembly 17, known as the "wash screen assembly", for radially removing liquor from the cellulose material. Liquor passing through the screens of assembly 17 enters one or more annular cavities 37 and is withdrawn by a plurality of radially directed nozzles 19 into ring-type header-pipe 19'. This liquor is then passed through one or more pipes 21 to the inlet of pump 22, known as the "wash circulation pump". The pump pressurizes the liquor and passes it through a conventional heat exchanger (not shown) and returns the liquor to the centrally-located distribution pipe 20, the "center-pipe", for re-introduction to the cellulose material. Cooking chemical or dilution liquor may also be introduced to conduit 21 upstream of pump 22.

Dilution liquor is typically introduced through a series of radially directed nozzles 23 located below the wash screen assembly 17. Dilution liquor is introduced to these nozzles by one or more common ring-type header-pipes 24. Dilution liquor, typically in the form of washer filtrate, is introduced using a pump 25, known as the "cold blow pump", and conduits 26 and 27. Dilution liquor is typically also introduced to the bottom head of the digester via nozzles 29 and conduit 28. The dilution liquor is mixed with the pulp and discharged from the vessel by an agitator 30, known as an "outlet device". The outlet device 30 is typically driven by an electric motor and gear reducer 31. Dilution liquor may also be distributed by the arms of the outlet device 30, pumped by pump 25 through conduit 32.

FIG. 2 also illustrates the typical increase in vessel diameter which accompanies the screen assembly 17. As is typical in conventional digester designs, the screen assembly 17 is followed by an increase in diameter 33, or "step-out", immediately below the screen. The radial removal of liquid using screen assembly 17 results in a localized compression of treated chips as they pass the screen assembly 17. This increase in the diameter of the flow path for the chip mass, or "chip column" as it is known, beneath the screen assembly 17 allows the chip mass to expand, or relax, into the void created by the step-out. This ensures that the vertical flow of material is not hindered by the localized radial compression due to radial liquor flow, that is, it prevents "hang-up" of the chip column on the screen. This increase in flow path diameter is produced by increasing the vessel shell diameter by about 6 inches on the radius from shell section 34 to section 36 using a conical transition 35.

As is typical of the prior art, nozzles 23 radially direct dilution liquor into the pulp and cannot uniformly distribute the liquor around the internal surface of the vessel shell 13. As discussed above, such localized introduction of liquor can result in localized variation in pulp slurry properties and localized variation in the flow characteristics of the cellulose material along the wall and bottom head of the digester 10. Again, such localized variation in flow can affect the flow of material throughout the height of the digester. FIGS. 3–6 illustrate embodiments of the present invention which minimize such variations and thus can improve the operation and performance of the entire digester.

Figure 3:
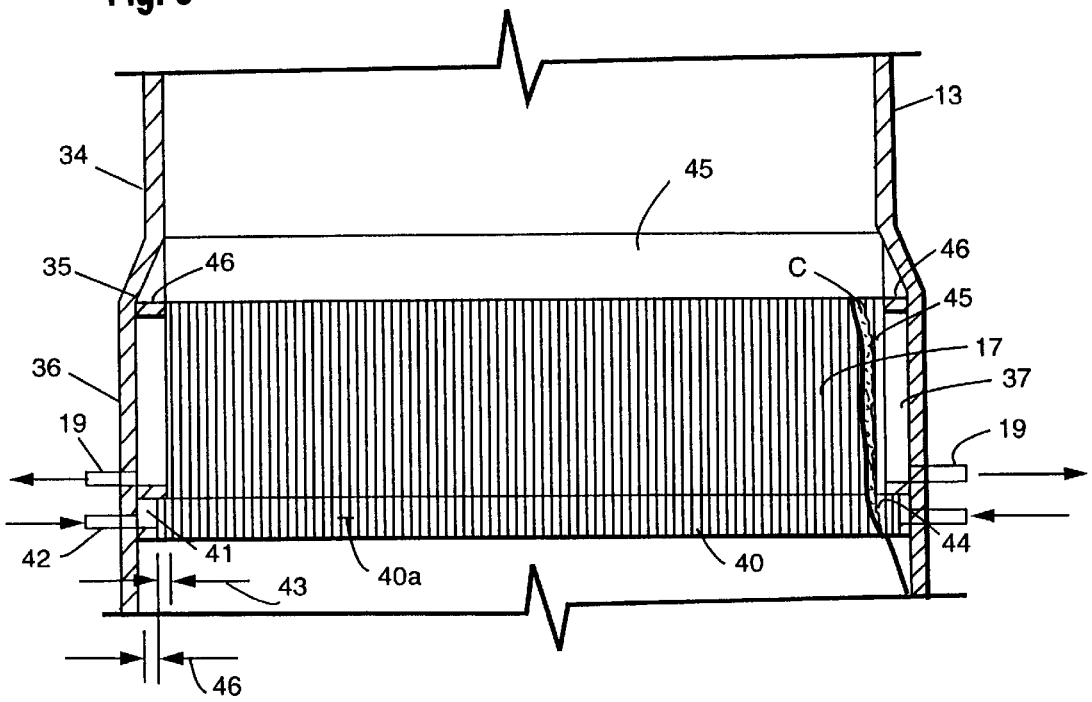
FIG. 3 is a longitudinal cross-sectional view of the dilution introducing arrangement according to the invention.

FIG. 3 is a schematic illustration of one embodiment of the present invention. FIG. 3 shows one section of vessel shell 13 comprising or consisting of the three sections 34, 35, and 36 shown in FIG. 2. Also shown is a typical wash circulation screen assembly 17 having one or more annular cavities 37 and liquor removal nozzles 19 as shown in FIG. 2. As is typical, the internal blank plate 45 maintains a relatively uniform diameter of the flow path as the diameter of the shell 13 transitions to the larger diameter via conical section 35. Screen assembly 17 is mounted on two or more support plates 46.

According to the present invention, at least one additional screen assembly 40 having an annular cavity 41 is located beneath screen assembly 17. A plurality of dilution liquor introducing nozzles 42 are provided to supply dilution liquor to the cavity 41. The internal diameter of the screen or screens of screen assembly 40 is greater than the internal diameter of screen assembly 17 (typically by at least 1%, e.g. about 2–5%) such that a step-out 43 exists beneath screen assembly 17. This substantially annular step increase in radius my vary from 0.5 to 24 inches, but is typically between 1 and 12 inches preferably about 1 to 3 inches in width. According to this invention, the presence of the step-out 43 provides a void 44 between the internal diameter of the screen or screens of assembly 40 and the expanding outer surface of the chip column shown schematically at 45 at the right side of FIG. 3. The dilution liquor introduced by nozzles 42 into annular cavity or header 41 passes through screen assembly 40 and into the annular void 44 created by step-out 43. The annular void 44 provides a path for distributing the dilution liquor around the circumference of the chip column so that localized dilution of the chip column is minimized or even eliminated. In one embodiment of this invention, the liquid is introduced directly to void 44 by way of one or more nozzles 42. However, the preferred embodiment includes some means for distributing the liquid substantially as uniformly as possible, such as on annular chamber 41.

The embodiment shown in FIG. 3 also includes a radial increase in flow path 46, that is, another step-out, beneath the screen assembly 40. The 1 to 6 inch step-out 46 can also provide a path for distributing liquor around the circumference of the chip column. The screen surface 40*a* of the screen assembly 40 provides for substantially uniform introduction of liquor about the periphery of or into the pulp slurry within vessel 13. The chips C flow approximately flush with screen 17.

Figure 4:
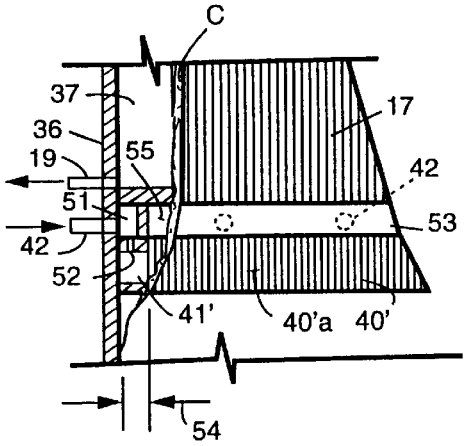
FIGS. 4, 5, and 6 are partial views, like those of FIG. 3, of alternatives for the dilution liquid introducing arrangement and method schematically shown in FIG. 3.
Figure 5:
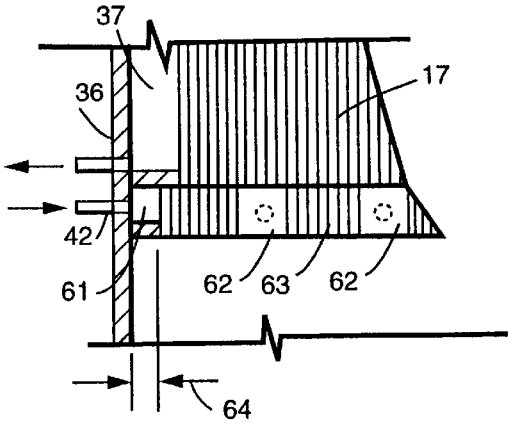
Figure 6:
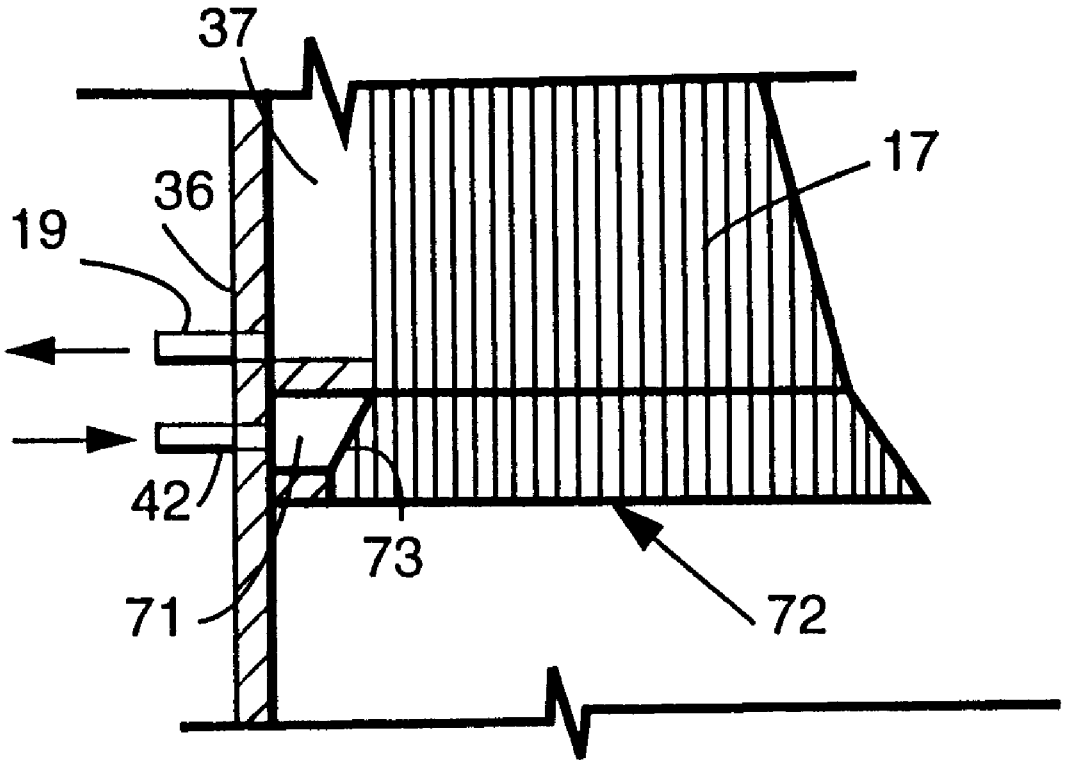

FIGS. 4–6 illustrate partial views of alternative embodiments of the embodiment shown in FIG. 3. FIG. 4 illustrates a screen assembly similar to the assembly shown in FIG. 3, including a vessel section 36, at least one screen assembly 17, liquor withdrawal conduit 19, step-out 43, and dilution liquor introduction conduit 42. In this embodiment, the dilution liquor is introduced to screen assembly 40' via an internal cavity or header 51 and then, through a series of orifices 52, and screen annular cavity or header 41', through screen surface 40'*a*. The internal header 51 is defined by a blank plate 53 located beneath the screen assembly 17. The plate 53 is shown having a height of about 6 inches for ease of illustration. Plate 53 may have any desired height but typically as a height between ½ to 6 feet. In FIG. 4, the step-out 43 is located beneath screen 17. However, it is understood that step-out 43 can be located beneath plate 53 such that the internal surface of screen 17 and plate 53 are essentially flush. In this embodiment, the annular void is crested below plate 53.

Conduits 42 also introduce liquid at one or more, typically, a plurality of evenly distributed locations as shown in phantom in FIG. 4. The orifices 52 ensure a relatively uniform distribution of liquid to annulus 41' and thus a uniform distribution of dilution liquor through the screen assembly 40' to the chip column. Since the orifices promote uniform distribution it may be possible to only have a single introduction point and still have uniform distribution. If desired the conduits 42 also could have cooperating orifices which penetrate plate 53. Plate 53 is positioned so as to create a step increase in flow path diameter to relieve chip column compaction and provide an annular void 55 into which the dilution liquor can flow. The step increase 54 in flow path diameter below screen assembly 40' provides further compaction relief and an additional annular void for the distribution of liquid. The internal annular cavity 51 may also be positioned above the annular cavity 41'. Liquid may also be distributed to the annular void via orifices or a screen plate in the lower plate of cavity 41', in lieu of or in conjunction with screen 40. Screen plate 40' may also be omitted and the dilution distributed by orifice 52 or a screen plate directly to the annular void.

FIG. 5 illustrates another alternative embodiment in which no internal distribution header, as shown in FIG. 4, is used, but the dilution liquor in conduit 42 flows directly into screen annular header 61. In this embodiment, the flow of dilution liquor is prevented from flowing from conduits 42 directly into the chip column by plates 62 positioned in front of the conduit inlets. These plates deflect the flow of liquor so that a more uniform distribution of liquid is provide to the screen surface 63. The step 64 provides column relief and a mechanism for uniform liquid distribution.

FIG. 6 illustrates still another embodiment of this invention in which the dilution screen assembly 72 comprises or consists of a right conical diverging screen section 73. This screen 73 is fed by conduits 42 and annular cavity 71. Similar conical or tapered screens can be used for screen surface 63, with plates 62, as shown in FIG. 5, or with the internal distribution header 51 shown in FIG. 4.

In each of the FIGS. 3–6 embodiments the various step outs, screen assemblies, blank plates, and the like, create a substantially annular void into which dilution liquor flows, so as to provide for substantially uniform introduction of the dilution liquor into the chip column. Such means may alternatively comprise any conventional structure for forming a substantially annual void, and dilution liquor may be introduced into the substantially annular void using any conventional liquid introducing structure or means, such as conduits, nozzles, pumps, orifices, headers, venturis, injectors, or the like, in place of or in addition to the substantially annular screens. The step outs, if utilized, are of the same proportional (e.g. about 1–5%) or absolute (e.g. about 0.5–24 inches, preferably about 1–12 inches) dimensions in each embodiment.

It will thus be seen that according to the present invention an advantageous digester, screen assembly, and method of treating a liquid slurry to produce chemical pulp (e.g. kraft), have been provided. The invention increases the potential to improve the circumferential distribution of dilution liquor to a vessel, especially a digester having dilution introduced into its lower section. It is to be understood that though the discussion above generally refers to the vessels in which the present invention can be used as digesters, this invention can be applied to any treatment vessel for treating comminuted cellulosic fibrous material that requires the uniform introduction of dilution or other treatment liquids. These include what are known in the art as impregnation or pretreatment vessels, but can also be used in and washing and bleaching vessels. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of treating or producing chemical pulp using a vessel having an interior surface, wherein the vessel is a digester having a top into which cellulosic fibrous material is introduced, and a bottom from which digested pulp is withdrawn; comprising the steps of:

(a) causing a cellulose slurry to flow in the vessel interior in a flow path;

(b) forming a substantially annular void at at least one point along the flow path, by providing a step out in the flow path;

(c) introducing dilution or treatment liquor into the substantially annular void so that the liquor is substantially uniformly distributed about the periphery of or into the slurry by causing treatment or dilution liquid to flow into the substantially annular void at a plurality of openings substantially evenly spaced around the substantially annular void, so that the liquid is substantially-uniformly distributed into the slurry;

(d) digesting the pulp prior to (c); and wherein (b) and (c) are practiced adjacent the bottom of the digester.

2. A method as recited in claim 1 wherein step (a) is practiced by causing the slurry to flow substantially downwardly in the vessel, and wherein step (b) is practiced by providing a step-out of between about 3–12 inches.

3. A method as recited in claim 1 wherein steps (b) and (c) are further practiced by disposing a screen, through which the liquid is introduced, adjacent the substantially annular void.

4. A method as recited in claim 3 wherein steps (b) and (c) are practiced by providing a screen surface substantially parallel to the flow path.

5. A method as recited in claim 3 wherein steps (b) and (c) are practiced by providing a substantially conical screen surface which makes an angle of about 30–60° with respect to the flow path.

6. A method as recited in claim 3 wherein step (c) is practiced by introducing treatment or dilution liquid into a first annular cavity within the vessel, causing the liquid to flow through a plurality of orifices into a second annular chamber within the vessel interior, and then through the screen into the vessel interior.

7. A method as recited in claim 1 wherein step (c) is practiced by introducing treatment or dilution liquid into a first annular cavity within the vessel, causing the liquid to flow through a plurality of orifices into a second annular chamber within the vessel interior, and then through a screen surface into the vessel interior.

8. A method as recited in claim 1 wherein step (b) is practiced by providing a step out of at least about 1%, and between about 1–12 inches.

9. A method as recited in claim 1 wherein step (c) is practiced by passing the liquor through a screen surface adjacent the annular void.

10. A method as recited in claim 1 wherein step (a) is practiced by causing the slurry to flow substantially downwardly in the vessel.

11. A method as recited in claim 1 wherein the vessel comprises a substantially vertically elongated vessel having an extraction or recirculating screen assembly having a first screen surface diameter; a step out substantially immediately below the extraction or recirculating screen assembly; a liquid introducing screen assembly substantially immediately below the step out, and having a second screen surface diameter greater than the first screen diameter by at least one percent; and a substantially annular header communicating with the liquid introducing screen assembly; and wherein step (c) is practiced by feeding liquid to the liquid introducing screen assembly for substantially uniform introduction into pulp moving downwardly in a slurry in the vessel.

12. A method as recited in claim 1 wherein step (c) is practiced by introducing treatment or dilution liquid into a first annular cavity within the vessel, causing the liquid to flow through a plurality of orifices into a second annular chamber within the vessel interior, and then through a screen surface into the vessel interior.

13. A method of treating or producing chemical pulp using a vessel having an interior surface, comprising the steps of:

(a) causing a cellulose slurry to flow in the vessel interior in a flow path;

(b) forming a substantially annular void at at least one point along the flow path; and (c) introducing dilution or treatment liquor into the substantially annular void so that the liquor is substantially uniformly distributed about the periphery of or into the slurry by introducing treatment or dilution liquid into a first annular cavity within the vessel by causing the liquid to flow through a plurality of orifices into a second annular chamber within the vessel interior, and then through a screen surface into the vessel interior.

14. A method of treating or producing chemical pulp using a vessel having an interior surface, comprising the steps of:

(a) causing a cellulose slurry to flow in the vessel interior in a flow path;

(b) forming a substantially annular void at at least one point along the flow path; and (c) introducing dilution or treatment liquor into the substantially annular void so that the liquor is substantially uniformly distributed about the periphery of or into the slurry, by passing the liquor through a screen surface adjacent the annular void.

15. A method as recited in claim 14 wherein step (a) is practiced by causing the slurry to flow substantially downwardly in the vessel.

16. A method as recited in claim 14 wherein step (c) is practiced by providing a screen surface substantially parallel to the flow path.

17. A method as recited in claim 14 wherein step (c) is practiced by providing a substantially conical screen surface which makes an angle of about 30–60° with respect to the flow path.

18. A method of treating or producing chemical pulp using a vessel having an interior surface, comprising the steps of:

(a) causing a cellulose slurry to flow in the vessel interior in a flow path;

(b) forming a substantially annular void at at least one point along the flow path;

(c) introducing dilution or treatment liquor into the substantially annular void so that the liquor is substantially uniformly distributed about the periphery of or into the slurry;

wherein the vessel comprises a substantially vertically elongated vessel having an extraction or recirculating screen assembly having a first screen surface diameter; a step out substantially immediately below the extraction or recirculating screen assembly; a liquid introducing screen assembly substantially immediately below the step out, and having a second screen surface diameter greater than the first screen diameter by at least one percent; and a substantially annular header communicating with the liquid introducing screen assembly; and wherein step (c) is practiced by feeding liquid to the liquid introducing screen assembly for substantially uniform introduction into pulp moving downwardly in a slurry in the vessel.

19. A method as recited in claim 18 wherein step (b) is further practiced by utilizing a substantially vertical second screen surface which has a diameter between about 0.4–24 inches greater than the first diameter.

20. A method as recited in claim 18 wherein step (c) is further practiced utilizing a plurality of conduits introducing liquid into the header, with a plate positioned in front of each conduit to deflect the flow of liquid from the conduit so that the liquid does not flow immediately into contact with the second screen surface; and introducing the liquid into the header so that it contacts the plate and is deflected thereby.

21. A method as recited in claim 18 wherein the header comprises a first header, and also utilizing a second header; and wherein step (c) is practiced by introducing liquid into both headers and providing a plurality of orifices between the first and second headers so that liquid flows therebetween.

* * * * *